US011131946B2

(12) United States Patent
Ikeda et al.

(10) Patent No.: US 11,131,946 B2
(45) Date of Patent: Sep. 28, 2021

(54) INTERMEDIATE TRANSFER BODY AND ELECTROPHOTOGRAPHIC IMAGE FORMING APPARATUS

(71) Applicant: Konica Minolta, Inc., Tokyo (JP)

(72) Inventors: Daisuke Ikeda, Hino (JP); Sadaaki Sakamoto, Hachioji (JP); Ito Koga, Hino (JP); Shiori Tsugawa, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/000,805

(22) Filed: Aug. 24, 2020

(65) Prior Publication Data

US 2021/0080874 A1 Mar. 18, 2021

(30) Foreign Application Priority Data

Sep. 18, 2019 (JP) ..... JP2019-169508

(51) Int. Cl.
*G03G 15/16* (2006.01)

(52) U.S. Cl.
CPC ..... *G03G 15/162* (2013.01)

(58) Field of Classification Search
CPC ..... G03G 15/162; G03G 2215/1623
See application file for complete search history.

(56) References Cited

U.S. PATENT DOCUMENTS 10,437,168 B2 * 10/2019 Koga ..... G03G 15/1615
10,656,568 B1 * 5/2020 Tsugawa ..... G03G 15/162
10,678,169 B1 * 6/2020 Yoshida ..... G03G 15/162

FOREIGN PATENT DOCUMENTS

JP H08-152759 A 6/1996

* cited by examiner

*Primary Examiner* — Thomas S Giampaolo, II
(74) *Attorney, Agent, or Firm* — Lucas & Mercanti, LLP

(57) ABSTRACT

Provided is an intermediate transfer body comprising a layer containing ferroelectric particles, wherein the ferroelectric particles has an average primary particle diameter in the range of 200 nm or less; and when three-dimensional axes of crystal lattices of the ferroelectric particles are a-axis, b-axis, and c-axis, a ratio of lattice constants of the c-axis and the a-axis (c/a) is in the range of 1.006 or more.

12 Claims, 4 Drawing Sheets

INTERMEDIATE TRANSFER BODY AND ELECTROPHOTOGRAPHIC IMAGE FORMING APPARATUS

CROSS-REFERENCE TO RELATED APPLICATIONS

The entire disclosure of Japanese Patent Application No. 2019-169508 filed on Sep. 18, 2019 is incorporated herein by reference in its entirety.

BACKGROUND

Technological Field

The present invention relates to an intermediate transfer body and an electrophotographic image forming apparatus. More particularly, the present invention relates to an intermediate transfer body capable of achieving both mechanical strength and transferability improvement even when a ferroelectric substance is added, and an electrophotographic image forming apparatus equipped with the same.

Description of the Related Art

In the past, as an electrophotographic image forming apparatus using an intermediate transfer body (it may be called as an intermediate transfer belt), the following is known. A toner image formed on a photoreceptor is firstly transferred onto an intermediate transfer body, and then, the toner image on the intermediate transfer body is secondary transferred to a transfer material such as a transfer paper (a recording paper). That is, after transfer of a toner image charged on a predetermined polarity formed on a photoreceptor to an intermediate transfer body, the toner image on the intermediate transfer body is further transferred onto a transfer material using electrostatic force.

An image forming apparatus using such an intermediate transfer body sequentially superimposes toner images formed on each photoreceptor onto an intermediate transfer body by utilizing electrostatic force. Further, it is possible to collectively transfer the superimposed toner images to the transfer material. Therefore, it is widely used for a color image forming apparatus.

Various performances such as transferability and cleaning property are required for the intermediate transfer body. Among them, a technique of dispersing a ferroelectric substance in an intermediate transfer body has been proposed in the past in order to improve transfer efficiency (for example, refer to Patent Document 1: JP-A 8-152759).

The range of the particle size of the ferroelectric substance may be adjusted according to the application and situation, but in general, the larger the particle size, the easier the particles to settle, and the uniform particle dispersibility during intermediate transfer body production becomes difficult to maintain. Therefore, uneven distribution of particles is likely to occur, the mechanical strength of the intermediate transfer body is weakened, and the intermediate transfer body is likely to break. Therefore, in order to ensure a certain level of mechanical strength, it is necessary to use a ferroelectric substance having a small particle size. However, it is generally known that there is a correlation between the particle size of the ferroelectric substance and the magnitude of the dielectric constant. That is, the smaller the particle size, the lower the dielectric constant, and the smaller the transferability improving effect. Therefore, in order to enhance the transferability improving effect, it is necessary to use a ferroelectric substance having a large particle size. In view of the above, it may be said that there is a trade-off relationship between the size of the particle and the magnitude of the dielectric constant of the ferroelectric substance, that is, between the mechanical strength and the transferability improving effect. In the prior art, it was not possible to achieve both mechanical strength and transferability improving effect in an intermediate transfer body containing a ferroelectric substance.

SUMMARY

The present invention has been made in view of the above-described problems and situations, and an object of the present invention is to provide an intermediate transfer body capable of achieving both mechanical strength and transferability improvement even when ferroelectric substance particles are added, and to provide an electrophotographic image forming apparatus equipped with the same.

The present inventors have found out the following in the process of examining the cause of the above problems in order to solve the above problems. It has been found that it is possible to provide an intermediate transfer body and an electrophotographic image forming apparatus provided with the same that is possible to achieve both mechanical strength and improvement of transferability by setting a particle size of the ferroelectric particles and a ratio of lattice constants (c/a) of c-axis and a-axis to be respectively in a specific range, even when the ferroelectric particles are added. To achieve at least one of the above-mentioned objects, an intermediate transfer body reflecting one aspect of the present invention is as follows.

An intermediate transfer body comprising a layer containing ferroelectric particles, wherein the ferroelectric particles has an average primary particle diameter in the range of 200 nm or less; and when three-dimensional axes of crystal lattices of the ferroelectric particles are a-axis, b-axis, and c-axis, a ratio of lattice constants of the c-axis and the a-axis (c/a) is in the range of 1.006 or more.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
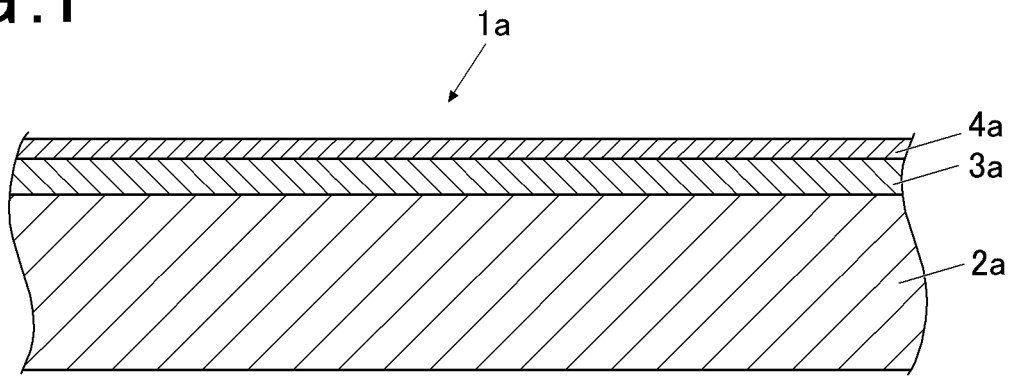
FIG. 1 is a conceptual sectional view illustrating an example of a layer structure of an intermediate transfer belt of the present invention.

Hereinafter, one or more embodiments of the present invention will be described. However, the scope of the invention is not limited to the disclosed embodiments. The intermediate transfer body of the present invention comprises a layer containing ferroelectric particles, wherein the ferroelectric particles has an average primary particle diameter in the range of 200 nm or less; and when three-dimensional axes of crystal lattices of the ferroelectric particles are a-axis, b-axis, and c-axis, a ratio of lattice constants of the c-axis and the a-axis (c/a) is in the range of 1.006 or more.

By the above means of the present invention, it is possible to provide an intermediate transfer body and an electrophotographic image forming apparatus capable of achieving both mechanical strength and improvement of transferability even when ferroelectric particles are added. The expression mechanism or the action mechanism of the effect of the present invention has not been clarified, but it is presumed as follows. By reducing the average primary particle diameter of the ferroelectric particles to be 200 nm or less, particle sedimentation is suppressed, and the ferroelectric particles may be uniformly dispersed in three dimension in the layer containing the ferroelectric particles. Further, in the ferroelectric substance, the larger the ratio value (c/a) of the lattice constants of the c-axis and the a-axis of the crystal lattices, the higher the dielectric constant. The principle is presumed to be as follows. In the following, barium titanate ($BaTiO_3$) will be described as an example of the ferroelectric substance. The large value of the ratio (c/a) means that the crystal structure is vertically long, and in that case, the titanium atom in the middle come to the position slightly displaced from the center as compared with the case where the value of the ratio (c/a) is low. Since the titanium atom is positively charged, when it shifts as described above, the positive charge is biased, that is, polarized. Therefore, the larger the value of the ratio (c/a), the greater the degree of this polarization and the higher the dielectric constant. With barium titanate having a normal particle size of 100 nm, the ratio value (c/a) is 1.005 or less, but the substance having the ratio value (c/a) of 1.006 or more may be produced by changing the production method. As a result of diligent studies, it was found that the 100 nm particles having the ratio value (c/a) of 1.006 have a higher dielectric constant than the 100 nm particles having the ratio value (c/a) of 1.005. Therefore, by increasing the ratio value (c/a) of the ferroelectric substance to 1.006 or more, a high dielectric constant, that is, an improvement in transferability is achieved. From the above, it is presumed that the uneven distribution of ferroelectric particles due to particle sedimentation is suppressed, and at the same time, the transferability improving effect due to the high dielectric constant is achieved.

In an embodiment of the present invention, when the relative permittivity of the layer containing the ferroelectric particles at a frequency of 1 MHz is in the range of 10 to 60, it is easy to strengthen the transfer electric field, further, it is preferable in that the adhesive force between the toner and the intermediate transfer body is increased and the transfer efficiency is not lowered.

It is preferable that the ferroelectric particles contain barium titanate or strontium titanate, because the transfer efficiency will be improved.

Further, it is preferable that the ratio (c/a) of the ferroelectric particles is 1.009 or more, since the mechanical strength and transferability may be further improved.

The inclusion of the ferroelectric particles in the range of 5 to 30% by volume with respect to the entire layer containing the ferroelectric particles may further improve the mechanical strength and transferability. This is a preferable embodiment.

It is preferable that the layer containing the ferroelectric particles contains a conductor, since the conductivity will be improved. The conductor is preferably carbon black in terms of conductivity and handling property. Carbon black is easy to handle because it gives the conductivity required for the intermediate transfer body and it is easily dispersed. Further, it is preferable that the conductor is a carbon nanotube because the amount of addition may be suppressed. Since carbon nanotubes have high conductivity, the conductivity may be improved with a small addition amount, and there is an effect of improving mechanical strength.

The content of the conductor in the range of 0.1 to 20% by volume with respect to the entire layer containing the ferroelectric particles makes it possible to improve the mechanical strength of the layer containing the ferroelectric particles and the charging amount of the toner. Further, it is preferable in that the layer containing the ferroelectric particles may be prevented from being contaminated.

It is preferable that the layer containing the ferroelectric particles is uniformly dispersed with the components that form the layer containing the ferroelectric particles, and it is preferable that a single layer is formed from the viewpoint of achieving both mechanical strength and transferability improvement.

It is preferable that a surface layer is provided on the layer containing the ferroelectric particles from the viewpoint of improving transferability of the intermediate transfer body.

The intermediate transfer body of the present invention is suitably used for an electrophotographic image forming apparatus.

The present invention and the constitution elements thereof, as well as configurations and embodiments to carry out the present invention, will be detailed in the following. In the present description, when two figures are used to indicate a range of value before and after "to", these figures are included in the range as a lowest limit value and an upper limit value.

[Intermediate Transfer Body]

The intermediate transfer body of the present invention is an intermediate transfer body having a layer containing ferroelectric particles, wherein an average primary particle diameter of the ferroelectric particles is 200 nm or less, and further, when the three-dimensional axes of the crystal lattices of the ferroelectric particles are a-axis, b-axis and c-axis, the ratio value (c/a) of the lattice constants of the c-axis and the a-axis is 1.006 or more.

<Average Primary Particle Diameter of Ferroelectric Particles>

An average primary particle diameter of the ferroelectric particles according to the present invention is 200 nm or less. The lower limit of the average primary particle diameter is 30 nm, more preferably 50 nm, and the optimum range is from 90 to 110 nm. The average primary particle diameter of the ferroelectric particles was measured by randomly measuring 200 or more particles using a transmission electron microscope (TEM) (manufactured by Hitachi High-Tech Co., Ltd.) and calculating the average value. Further, when the shape of the particles is not spherical, the average value of the long diameter and the short diameter can be calculated as the size of each particle.

<Value of Ratio of Lattice Constants of c-Axis and a-Axis (c/a)>

When the three-dimensional axes of the crystal lattices of the ferroelectric particles according to the present invention are a-axis, b-axis and c-axis, the ratio (c/a) of the lattice constants of the c-axis and the a-axis is 1.006 or more, more preferably, it is 1.009 or more. The practical upper limit value is 1.010. The value of the ratio (c/a) is calculated as follows.

(X-Ray Diffraction (XRD))

Measurement is done with an X-ray diffractometer (D8 ADVANCE/V) manufactured by Bruker AXS, and the ratio of the lattice constants (value of the ratio (c/a)) is obtained from qualitative analysis or quantitative analysis by Rietveld analysis.

The intermediate transfer body of the present invention may contain ferroelectric particles having an average primary particle diameter and a value of the ratio (c/a) outside the above-described range at an impurity level within a range that does not impair the effects of the present invention. The impurity level is a level of 0.1 volume % or less with respect to the total volume of the layer containing the ferroelectric particles. It is limited to a level that does not change the dielectric properties of the intermediate transfer body or particle sedimentation.

<Relative Permittivity>

The relative permittivity of the layer containing the ferroelectric particles at a frequency of 1 MHz is preferably in the range of 10 to 60 in an environment of a temperature of 23° C. and a humidity of 50% RH. A relative permittivity of 10 or more is preferable because it is easy to increase the transfer electric field. On the other hand, when the relative permittivity is 60 or less, the adhesive force between the toner and the intermediate transfer body is increased and the transfer efficiency is not lowered, which is preferable.

Figure 5:
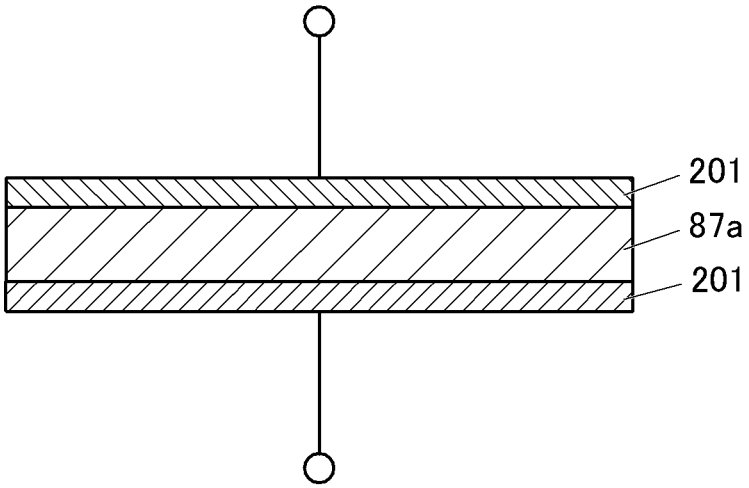
FIG. 5 is a schematic diagram for explaining a method of measuring a dielectric constant.

The relative permittivity may be measured by the following method. The dielectric constant measurement is conducted for the layer containing the ferroelectric particles of the intermediate transfer body. Specifically, as illustrated in FIG. 5, a thin film electrode 201 having a resistance of one digit Ω is formed on both surfaces of the intermediate transfer body 87*a* by sputtering and cut out with a 10 mmφ mold to prepare a measurement sample. Using an impedance analyzer "1260/1296" (made of Solartron Analytical Co., Ltd.), the dielectric constant (F/m) is measured by the electrode contact method under the conditions of a frequency of 1 MHz and a temperature of 23° C. and a humidity of 50% RH. The relative permittivity is obtained by conversion from the dielectric constant.

The relative permittivity may be adjusted to an appropriate value by adjusting the type and content of the ferroelectric used for the ferroelectric particles in the intermediate transfer body.

[Layer Structure of Intermediate Transfer Body]

FIG. 1 is a conceptual sectional view illustrating an example of the layer structure of the intermediate transfer body of the present invention. The intermediate transfer body 1*a* of the present invention may have a single-layer structure composed of only one layer containing the ferroelectric particles according to the present invention (hereinafter, also referred to as a substrate layer 2*a*). However, if necessary, an elastic layer 3*a* and a surface layer 4*a* may be provided in this order on the substrate layer 2*a*.

The thickness of the intermediate transfer body may be appropriately determined according to the purpose of use, but it is preferably in the range of 50 to 100 μm. The thinner the thickness, the lower the voltage required for the transfer, the more the discharge is suppressed, and the higher the transfer efficiency. Therefore, the thickness is preferably 100 μm or less. Further, when the thickness is 50 μm or more, the strength of the intermediate transfer body may be sufficiently maintained.

The electric resistance value (volume resistivity) of the intermediate transfer body is preferably in the range of $10^5$ to $10^{11}$ Ω·cm. The electric resistance value may be controlled by the content of the conductor. The shape of the intermediate transfer body is preferably an endless intermediate transfer body, because there is no change in thickness due to superposition, and an arbitrary portion may be set as the intermediate transfer body rotation start position, and the control mechanism for the rotation start position may be omitted.

<Substrate Layer>

The substrate layer according to the present invention contains ferroelectric particles. Further, the substrate layer preferably contains a conductor. Particularly, it is preferable that the substrate layer contains a resin in which the ferroelectric particles and the conductor are uniformly mixed and dispersed. That is, it is preferable that the substrate layer is uniformly dispersed with the components that form the substrate layer to form a single layer. Here, "uniformly dispersed" means the case in which the interface between the region where only the ferroelectric particles are filled and the region where only the conductor is filled in the layer is not visible in the photograph taken for observing the substrate layer with a scanning electron microscope. However, it is allowed that the ferroelectric particles and the conductor are partially aggregated to the extent that the effects of the present invention are not impaired. As described above, the ferroelectric particles has an average primary particle diameter in the range of 200 nm or less, and when the three-dimensional axes of the crystal lattices of the ferroelectric particles are a-axis, b-axis and c-axis, the ratio (c/a) of the lattice constants of the c-axis and the a-axis is 1.006 or more, more preferably, it is 1.009 or more. Although the upper limit of the ratio value (c/a) is not particularly limited, practically it is 1.010.

The ferroelectric particles according to the present invention are ferroelectric fine particles. In the present invention, a ferroelectric substance is a kind of a dielectric substance, and it is a substance in which electric dipoles are aligned even if there is no electric field outside and the direction of the dipole may be changed by the electric field. Specifically, in the present invention, the ferroelectric substance means a substance having a relative permittivity of 15 or more at a frequency of 1 MHz under an environment of a temperature of 23° C. and a humidity of 50% RH. The relative permittivity is preferably 20 or more, more preferably 100 or more. A higher dielectric constant is preferable from the viewpoint of manifesting the effects of the present invention. The upper limit is limited by material availability.

In addition, the state in which the electric dipole moments are spontaneously aligned in this manner is called a ferroelectric state, and this property is called ferroelectricity. Among the materials having ferroelectricity, in the present invention, ferroelectric ceramics are desirable as the ferroelectric particles because of the load in the production process and the stability when used over time. Examples of the ferroelectric ceramic include barium titanate, calcium titanate, strontium titanate, magnesium titanate, and calcium zirconate. Further, solid solutions of these substances may be used as the ferroelectric particles. Of these, barium titanate or strontium titanate is more preferable for the ferroelectric particles according to the present invention.

The method for producing barium titanate is not particularly limited, but it may be produced by, for example, the method described in paragraphs 0033 to 0044 of Japanese Patent No. 6368246. Specifically, an aqueous solution containing barium and titanium hydroxide is prepared, and the aqueous solution is subjected to hydrothermal reaction under high temperature and high pressure conditions. The temperature of the hydrothermal reaction is 200° C. or higher, preferably 200 to 450° C., more preferably 250 to 400° C., and the total pressure is 2 MPa or higher, preferably 2 to 50 MPa, more preferably 10 to 40 MPa. The reaction may be carried out for 0.1 minute or more, preferably 0.1 minute to 1 hour, more preferably 0.1 to 30 minutes. Hydrothermal reaction is carried out under such high temperature and high pressure conditions to control the particle morphology such as the above-mentioned ratio value (c/a) and the average primary particle diameter. Then, after filtration, washing with water, drying and crushing, barium titanate particles are obtained. Means for keeping the value of the ratio and the average primary particle diameter within the above ranges according to the present invention include controlling of the types of raw materials in the aqueous solution containing barium and titanium hydroxide, the Ba/Ti ratio, the amount of alkali, and the reaction scale, the reaction temperature, reaction pressure, and reaction time. The method for producing strontium titanate is not particularly limited, and it may be produced by the same method as barium titanate described above.

The ferroelectric particles according to the present invention preferably contain the ferroelectric particles in an amount of 5 to 30% by volume with respect to the entire substrate layer (layer containing the ferroelectric particles). When it is at least 5% by volume, there is an effect of increasing the dielectric constant of the intermediate transfer body, that is, an effect of improving transferability. When it is 30% by volume or less, it may have required mechanical strength.

(Conductor)

In the present invention, the conductor is not particularly limited as long as it is a substance having conductivity. Specifically, as the conductor (conducting agent) used in the present invention, a known electron conductive substance or ionic conductive substance may be used, but the preferable conductor is carbon black, carbon nanotube, graphite or graphene. Among them, carbon black and carbon nanotubes are more preferable from the viewpoint of giving conductivity to the intermediate transfer body and easy handling. The added amount of the conductor used in the present invention is preferably in the range of 0.1 to 20% by volume with respect to the entire substrate layer (layer containing ferroelectric particles). When the content is 0.1% by volume or more, the toner is not contaminated on the surface of the substrate layer, and when the content is 20% by volume or less, the strength of the substrate layer and the decrease in the charge amount of the toner are not observed, which is good. It is more preferably in the range of 0.5 to 15% by volume, and even more preferably in the range of 1 to 10% by volume.

(Carbon Black)

Among the conductors, examples of the carbon black include: gas black, acetylene black, oil furnace black, thermal black, channel black, and Ketjen black may be mentioned. Ketjen black, acetylene black and oil furnace black may be cited as effective ones for obtaining a desired conductivity with a smaller amount of mixing. It should be noted that Ketjen black is carbon black of a contactive furnace system.

The average primary particle diameter of carbon black is preferably in the range of 10 to 50 nm from the viewpoint of easily controlling the coverage of the ferroelectric particles with the conductor to an appropriate value. The average primary particle diameter may be measured with an apparatus of FPAR-1000 (manufactured by Otsuka Electronics Co., Ltd.) using a photon counting method.

(Carbon Nanotube)

A carbon nanotube (hereinafter abbreviated as CNT) is a single-layer structure having no defects or a multilayered tube-like material in which graphite hexagonal mesh planes are rounded into a cylindrical shape, or in which they are laminated in a nested manner. The average tube diameter of the CNT contained in the intermediate transfer body of the present invention is preferably in the range of 10 to 150 nm, and the length of the CNT is preferably in the range of 5 to 12 μm. By setting the diameter and length of the CNTs within the above ranges, appropriate conductivity may be imparted to the intermediate transfer body, and the ferroelectric particles may be efficiently coated.

This CNT may have a functional group covalently bonded as necessary. For example, by chemically treating CNTs with strong acid, an oxidized CNT with a carboxylic acid group introduced on the surface is produced, and after reacting the oxidized CNT with thionyl chloride, and reacting with alkyl alcohol, a chemically modified CNT that dissolves in organic solvents may be produced. By using such chemically modified CNT, the CNT may be uniformly dispersed in the resin. Further, by applying an electric field from the outside to the CNT dispersed in the resin, the CNT may be oriented in a desired direction, and the dielectric constant of the intermediate transfer body may be improved.

The average tube diameter and the length may be obtained from a scanning electron microscope (SEM) photograph of the cross section of the intermediate transfer body, and it is possible to adjust them by cutting (pulverizing) CNT or mixing two or more CNTs.

(Graphite)

As the graphite used in the present invention, either a natural product or a synthetic product may be used. The preferred graphite particle size is difficult to define uniquely due to the fact that the shape of the graphite is scaly and that the shape changes in the dispersion process during the production of the toner carrier. However, it is preferable that the width in the major axis direction (the fracture surface direction) is 100 μm or less. As a measuring method, a sample is directly observed with a microscope and measured.

(Graphene)

Graphene is a sheet-like substance having a planar hexagonal lattice structure of carbon atoms. The graphene sheet is flat graphene and is usually a single layer. The graphene sheet is an artificial material and may be obtained as a flaky powder. For example, it may be produced by a chemical vapor deposition (CVD) method.

The graphene sheet may not be completely a single layer, and may partially include two or more layers. For this reason, the graphene sheet has, for example, less than 2 layers. The size is preferably less than 2 μm and the thickness is preferably 2 nm or less. The graphene sheet laminate preferably has, for example, two or more layers, a size of 5 to 25 μm, and a thickness of 12 nm or less.

A commercial item may be used for a graphene sheet and its laminated body. The number of layers, the size, and the thickness of the graphene sheet and the laminate thereof may be measured by, for example, a transmission electron microscope (TEM).

(Resin)

The substrate layer according to the present invention preferably contains the ferroelectric particles or the ferroelectric particles coated with the conductor in a state of being dispersed in a resin. Various types of resin may be used. Preferable resins are super engineering plastics having strength and durability such as polyimide (PI), polyamide-imide (PAH, polyphenylene sulfide (PPS), and polyetheretherketone (PEEK).

Of these, polyimide, polyimide and polyamideimide are preferable. Among them, polyimide is more preferable since it is excellent in characteristics such as heat resistance, bending resistance, flexibility, and dimensional stability. Polyimide is obtained, for example, by synthesizing a polyamic acid (polyimide precursor) from an acid anhydride and a diamine compound, and imidizing the polyamic acid with heat or a catalyst.

The acid anhydride used for the synthesis of polyimide is not particularly limited. Examples thereof are aromatic tetracarboxylic dianhydrides such as: biphenyltetracarboxylic dianhydride, terphenyltetracarboxylic dianhydride, benzophenonetetracarboxylic dianhydride, pyromellitic anhydride, oxydiphthalic dianhydride, diphenylsulfone tetracarboxylic dianhydride, hexafluoroisopropylidene diphthalic acid dianhydride, and cyclobutanetetracarboxylic acid dianhydride.

The diamine compound used for the synthesis of polyimide is not particularly limited. Examples thereof are aromatic diamines such as: p-phenylenediamine, m-phenylenediamine, 2,4-diaminotoluene, 4,4'-diaminodiphenylmethane, 4,4'-diaminodiphenyl ether, 3,4'-diaminodiphenyl ether, 3,3'-dimethyl-4,4'-diaminobiphenyl, 2,2'-bis(trifluoromethyl)-4,4'-diaminobiphenyl, 3,7-diamino-dimethyldibenzothiophene-5,5'-dioxide, 4,4'-diaminobenzophenone, 4,4'-bis(4-aminophenyl) sulfide, 4,4'-diaminobenzanilide, and 1,4-bis(4-aminophenoxy)benzene.

The resin according to the present invention is preferably contained in the range of 50 to 95% by volume with respect to the entire base material layer. When it is 50% by volume or more, it may obtain required mechanical strength. When it is 95% by volume or less, a space containing a ferroelectric substance or a conductor may be secured.

<Elastic Layer>

The elastic layer is a layer having desired conductivity and elasticity that may be formed on the outer peripheral surface of the substrate as necessary. The elastic layer is made of a rubber material. The thickness of the elastic layer is, for example, 50 to 400 μm. Examples of the rubber material include resins having rubber elasticity such as urethane rubber, chloroprene rubber (CR), and nitrile rubber (NBR). The rubber material preferably contains chloroprene rubber or nitrile butadiene rubber from the viewpoint of controlling the electric resistance of the intermediate transfer body.

<Surface Layer>

According to necessity, the surface layer (the outer layer) may be formed on the outer peripheral surface of the substrate or the outer peripheral surface of the elastic layer. It is preferable that the surface layer is obtained by a coating film formed with a coating liquid for forming a surface layer containing an active energy ray-curable composition including: metal oxide fine particles (A); a (meth)acrylate monomer (B) having a refractive index nD in the range of 1.6 to 1.8; and a polyfunctional (meth)acrylate (C) other than the (meth)acrylate monomer (B), then by irradiating the coating film with active energy rays and curing. Thereby the durability of the intermediate transfer body may be improved.

Next, a method for producing an intermediate transfer body provided with a layer (substrate layer) containing ferroelectric particles according to the present invention will be described. The following manufacturing method is an example, and any method capable of manufacturing an intermediate transfer body may be used. First, a dispersion liquid A in which ferroelectric particles are dispersed in a solvent is prepared. When needed, a dispersion liquid B in which a conductor is dispersed in a solvent is also prepared. Here, both the dispersion liquid A and the dispersion liquid B may use a dispersant to the extent that it does not affect the dielectric constant and mechanical properties. The prepared dispersion liquid A and dispersion liquid B are mixed and dispersed with a resin of polyimide varnish "UPIA-AT (U-Varnish-A)" (manufactured by Ube Industries Ltd.). At this time, the content of the ferroelectric particles and the conductor is appropriately adjusted so as to fall within a preferable range. The mixing-dispersing operation may be performed using a mixer. The ferroelectric particles and, if necessary, the conductor may be mixed and dispersed in the polyimide varnish without preparing the dispersion liquid A and the dispersion liquid B. The coating liquid for forming the substrate layer may be prepared by the mixing-dispersing operation.

Next, while rotating the stainless steel cylindrical mold around the cylindrical axis, the dispensing nozzle is moved in the axial direction, and the coating liquid for forming the substrate layer is discharged from the nozzle. The coating liquid is applied spirally on the outer peripheral surface of the mold to form a coating film connecting them. Next, most of the solvent is volatilized by heating at 130° C. for 1 hour while rotating the cylindrical mold, and then heated at 350° C. for 1 hour to form an endless belt-like substrate layer. Then, this substrate layer is processed to obtain an intermediate transfer body in which ferroelectric particles and/or conductors are dispersed in the entire resin. The intermediate transfer body may be produced using only the substrate layer produced by the above method, or the intermediate transfer body may be produced by bonding the elastic layer and the surface layer to the substrate layer. A known method may be used for forming the elastic layer and the surface layer and it is not particularly limited.

[Electrophotographic Image Forming Apparatus]

Next, an electrophotographic image forming apparatus provided with the intermediate transfer body of the present invention will be described. As indicated in FIG. 2, for example, the electrophotographic image forming apparatus of the present invention (hereinafter also referred to as an image forming apparatus) is a tandem image forming apparatus having photosensitive drums 83Y, 83M, 83C, and 83K as photoreceptors corresponding to four colors of yellow (Y), magenta (M), cyan (C), and black (K) arranged in series in the running direction of the intermediate transfer body.

Figure 3:
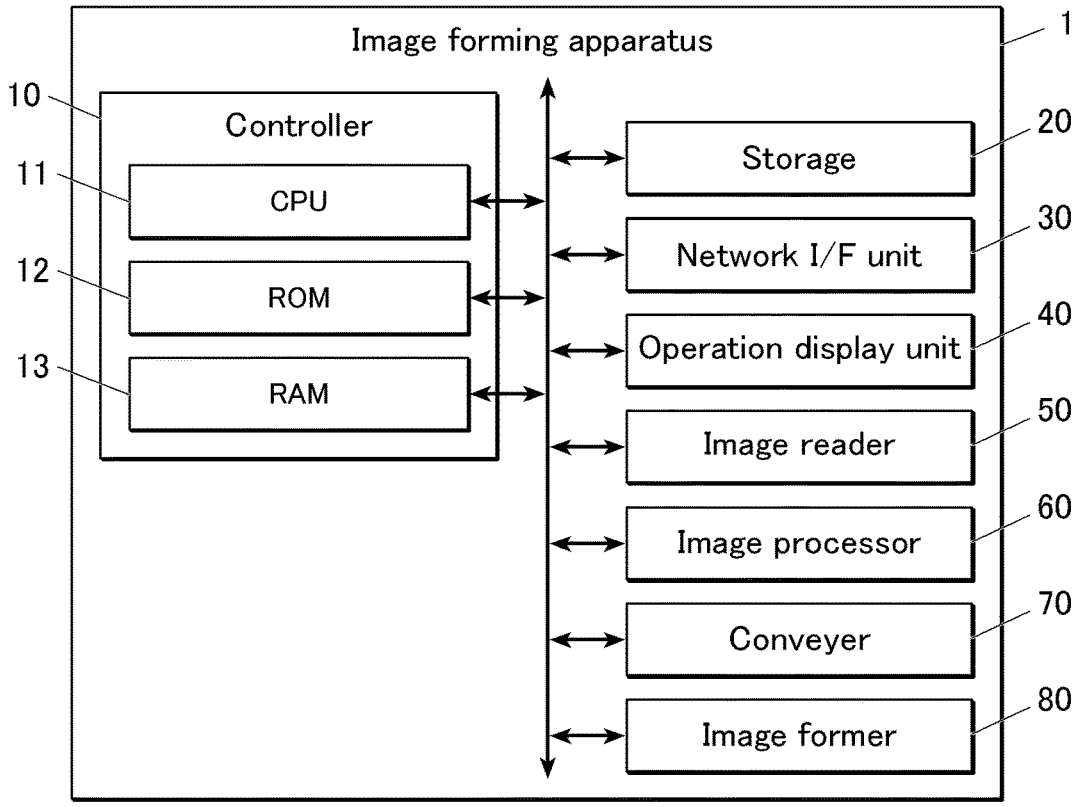
FIG. 3 is a block diagram indicating a configuration of an image forming apparatus of the present invention.

As indicated in FIG. 3, the image forming apparatus 1 has the following units: a controller 10 configured by a CPU (Central Processing Unit) 11, a ROM (Read Only Memory) 12, and a RAM (Random Access Memory) 13; a storage 20 configured by a SSD (Solid State Drive); a network I/F unit 30 configured by a NIC (Network Interface Card) and a modem; a operation display unit 40 configured by a touch panel; an image reader 50 configured by an ADF (Auto Document Feeder) and a scanner; an image processor 60 configured by a RIP (Raster Image Processor); a conveyer 70; and image former 80. The image former 80 that processes the paper transported from the conveyer 70 includes the intermediate transfer body of the present embodiment.

Figure 2:
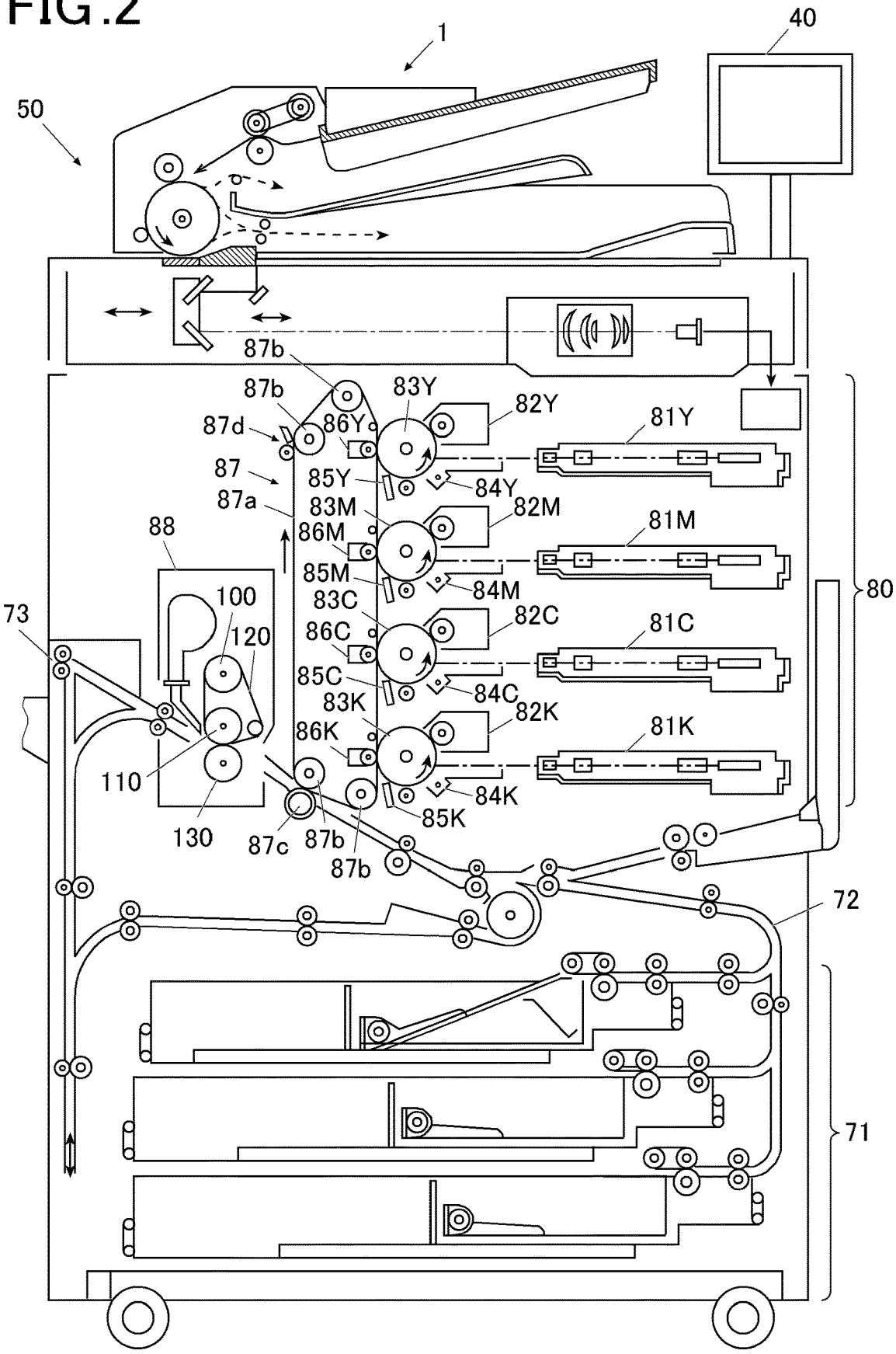
FIG. 2 is a schematic diagram illustrating a structure of an image forming apparatus of the present invention.

As indicated in FIG. 2, the conveyer 70 includes a paper feeding device 71, a conveyance mechanism 72, a paper discharge device 73. The sheets of paper stored in the paper feeding device 71 are sent one by one from the top and are conveyed to the image former 80 by the conveyance mechanism 72 having a plurality of conveyance rollers such as registration rollers. At this time, the registration unit provided with the registration rollers corrects the inclination of the fed paper and adjusts the conveyance timing. The paper on which the image is formed by the image former 80 is discharged to a discharge tray outside the apparatus by a discharge device 73 having a discharge roller.

Figure 4:
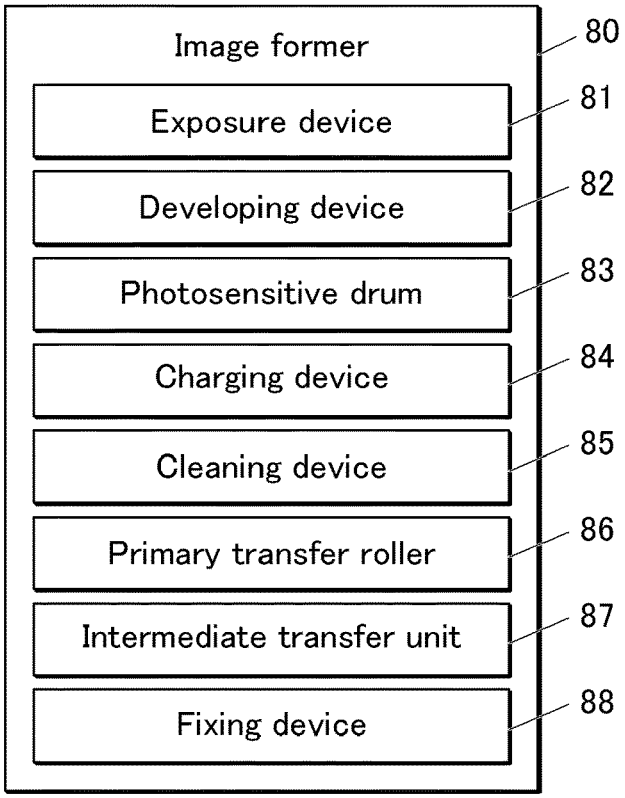
FIG. 4 is a block diagram indicating a configuration of an image forming apparatus of the present invention.

As indicated in FIG. 2 and FIG. 4, the image former 80 is configured by the following: an exposure device 81 (81Y, 81M, 81C, 81K), a developing device 82 (82Y, 82M, 82C, 82K), a photosensitive drum 83 (83Y, 83M, 83C, 83K), a charging device 84 (84Y, 84M, 84C, 84K), a cleaning device 85 (85Y, 85M, 85C, 85K), a primary transfer roller 86 (86Y, 86M, 86C, 86K), an intermediate transfer unit 87, a fixing device 88, which are provided corresponding to different color components Y, M, C, and K. Hereinafter, each element will be outlined. In the following description, symbols excluding Y, M, C, and K are used as necessary.

The photosensitive drum 83 of each of the color component Y, M, C, and K is an image carrier formed by an organic photosensitive layer (OPC) in which an overcoat layer as a protective layer is provided on the outer peripheral surface of a cylindrical metal base made of an aluminum material. The photosensitive drum 83 is rotated in the counterclockwise direction in FIG. 2 following the intermediate transfer body while being grounded.

The charging device 84 for each of the color components Y, M, C, and K is a scorotron type, and is disposed close to the corresponding photosensitive drum 83 in a state where the longitudinal direction thereof is along the rotational axis direction of the photosensitive drum 83. A uniform potential is applied to the surface of the photosensitive drum 83 by corona discharge having the same polarity as the toner.

The exposure device 81 for each of the color components Y, M, C, and K performs scanning in parallel with the rotation axis of the photosensitive drum 83 by, for example, a polygon mirror. An electrostatic latent image is formed by performing image exposure on the surface of the corresponding photosensitive drum 83 that is uniformly charged based on the image data.

The developing device 82 of each of the color components Y, M, C, and K accommodates a two-component developer composed of a toner having a small particle diameter of the corresponding color component and a magnetic material. The developing device conveys the toner to the surface of the photosensitive drum 83, and the electrostatic latent image carried on the photosensitive drum 83 is visualized with the toner.

A primary transfer roller 86 for each of the color components Y, M, C, and K presses the intermediate transfer body of this embodiment against the photosensitive drum 83, and sequentially superimposes the respective color toner images formed on the corresponding photosensitive drum 83 to primary transfer onto the intermediate transfer body.

The cleaning device 85 for each of the color components Y, M, C, and K collects residual toner remaining on the corresponding photosensitive drum 83 after the primary transfer. Also, a lubricant application mechanism (not indicated) is provided adjacent to the cleaning device 85 on the downstream side in the rotation direction of the photosensitive drum 83, and the lubricant is applied to the photosensitive surface of the corresponding photosensitive drum 83.

The intermediate transfer unit 87 includes an endless intermediate transfer body 87*a* to be a transfer target, a support roller 87*b*, a secondary transfer roller 87*c*, and an intermediate transfer cleaning unit 87*d*, and the intermediate transfer body 87*a* is stretched between a plurality of support rollers 87*b*. The intermediate transfer body 87*a*, on which the color toner images are primarily transferred by the primary transfer rollers 86Y, 86M, 86C, and 86K, is pressed against the paper by the secondary transfer roller 87*c*. Then, the toner image is secondarily transferred to the paper by the electric field acting on the toner based on the transfer voltage between the intermediate transfer body 87*a* and the secondary transfer roller 87*c*, and the paper is sent to the fixing device 88. The intermediate transfer cleaning unit 87*d* has a belt cleaning blade that is in sliding contact with the surface of the intermediate transfer body 87*a*. The transfer residual toner remaining on the surface of the intermediate transfer body 87*a* after the secondary transfer is scraped off and removed by the belt cleaning blade.

The fixing device 88 includes a heating roller 88*a* serving as a heat source, a fixing roller 88*b*, a fixing belt 88*c* and a pressure roller 88*d* that are stretched over the heating roller 88*a* and the fixing roller 88*b*. A pressure roller 88*d* is pressed against the fixing roller 88*b* via the fixing belt 88*c*, and the pressure contact portion forms a nip portion.

The paper on which the toner image is fixed by the fixing device 88 is discharged to a discharge tray outside the apparatus by a discharge device 73 having a discharge roller.

FIG. 2 and FIG. 4 illustrate an example of the image forming apparatus 1 according to the present invention. As long as the intermediate transfer body 87*a* according to the present invention is used, the structure and configuration thereof may be changed as appropriate.

EXAMPLES

Hereinafter, the present invention will be specifically described with reference to examples, but the present invention is not limited thereto. In the following examples, the operations were performed at room temperature (25° C.) unless otherwise specified. Further, unless specified otherwise, "%" and "part" mean "mass %" and "part by mass", respectively.

[Synthesis of Barium Titanate Particles]

With reference to paragraphs 0033 to 0044 of Japanese Patent No. 6368246, an aqueous titanium hydroxide-containing solution was used as an aqueous titanium salt solution, an aqueous barium nitrate solution was used as an aqueous barium salt solution, and an aqueous sodium hydroxide solution was used as an aqueous alkaline solution. The raw materials were prepared so that the Ti amount was 10 mol, the Ba amount was 10 mol, and the alkali amount was 60 mol [neutralization degree=alkali amount/(4×Ti amount+2×Ba amount)=1.0]. Next, in a raw material tank, after adding the aqueous sodium hydroxide solution to the aqueous titanium hydroxide-containing solution at room temperature in the atmosphere, the aqueous barium nitrate solution was added. Thus, an aqueous solution containing amorphous barium and titanium hydroxide as reaction precursors was prepared. The pH value of the reaction precursor after preparation was 13.2. The prepared reaction precursor was hydrothermally reacted at a temperature of 400° C., a pressure of 25 MPa and a residence time of 0.4 minutes by a continuous hydrothermal reaction apparatus. Then the reaction mixture was filtered, washed with water and dried to obtain barium titanate particles. The obtained barium titanate particles were evaluated for X-ray diffraction and average primary particle diameter by the methods described above. Rietveld analysis by X-ray diffraction revealed that the barium titanate particles had a (c/a) ratio of 1.009 and an average primary particle diameter of 100 nm.

Further, in the synthesis of the barium titanate particles, the barium titanate particles having an average primary particle size and a (c/a) ratio as indicated in Table I below were synthesized by appropriately changing the temperature, pressure and residence time of the hydrothermal reaction.

[Synthesis of Strontium Titanate Particles]

After conducting iron-bleaching treatment to metatitanic acid obtained by the sulfuric acid method, an aqueous sodium hydroxide solution was added to adjust the pH to 8.8, and desulfurization treatment was performed. Then, the mixture was neutralized to pH 5.7 with hydrochloric acid, filtered and washed with water. Water was added to the washed cake to make $TiO_2$ into a slurry having a concentration of 1.85 mol/L, and then hydrochloric acid was added to adjust the pH to 1.0 to perform peptization treatment. 0.63 mol of this metatitanic acid was sampled in terms of $TiO_2$ and charged into a 3 L reaction vessel. Next, 0.71 mol of an aqueous strontium chloride solution was added so that the $SrO/TiO_2$ molar ratio was 1.14, and then the $TiO_2$ concentration was adjusted to 0.28 mol/L. Next, after heating to 90° C. while stirring and mixing, 290 mL of a 5N aqueous sodium hydroxide solution was added over 16 hours, and then stirring was continued at 95° C. for 1 hour to complete the reaction. The reaction slurry was cooled to 50° C., hydrochloric acid was added until the pH reached 5.0, and stirring was continued for 1 hour. The obtained precipitate was washed by decantation, filtered, and then dried in the atmosphere at 120° C. for 8 hours to obtain strontium titanate particles.

[Preparation of Intermediate Transfer Body 1]

A dispersion liquid A in which the barium titanate particles (average primary particle diameter of 100 nm, c/a=1.009) synthesized above and dispersed in a solvent (N-methyl-2-pyrrolidone) was prepared, and a dispersion liquid B in which carbon black (MA8: manufactured by Mitsubishi Chemical Co., Ltd.) was dispersed in a solvent (N-methyl-2-pyrrolidone) was prepared. The dispersion liquids A and B were added to a resin of polyimide varnish "UPIA-AT (U-Varnish-A)" (manufactured by Ube Industries, Ltd.) so that barium titanate was 15% by volume and carbon black was 7% by volume. Then, they were mixed using a mixer to prepare a coating liquid for forming a substrate layer. Next, while rotating the stainless steel cylindrical mold around the cylindrical axis, with moving the dispenser nozzle in the axial direction, the substrate layer forming coating liquid was discharged from the nozzle spirally on the outer peripheral surface of the mold, and a continuous coating film was formed. Next, most of the solvent was volatilized by heating at 130° C. for 1 hour while rotating the cylindrical mold, and then at 350° C. for 1 hour to form an endless belt-shaped substrate layer. The thickness of the substrate layer formed by the above method was 65 μm. Then, this substrate layer was processed to prepare an intermediate transfer body 1 in which barium titanate and carbon black were dispersed in the entire resin. Further, SSG HB21B (manufactured by Nittobo Medical Co., Ltd.) was applied onto the intermediate transfer body 1 by a dip coating method to form a surface layer.

[Preparation of Intermediate Transfer Bodies 2 to 10]

Intermediate transfer bodies 2 to 10 were produced in the same manner as used for the production of the intermediate transfer body 1 except that the types and addition amounts of the ferroelectric particles and the conductors were changed as indicated in Table I below. The intermediate transfer body 10 was not provided with a surface layer. The following materials were used as the materials used in the production of each intermediate transfer body.

Carbon black: "MA8" (manufactured by Mitsubishi Chemical Co., Ltd.)

Carbon nanotube: "CNTs 40(N)" (manufactured by SUSN Co., Ltd.)

[Production of Intermediate Transfer Body 11]

In the dispersion liquid A and the dispersion liquid B prepared when the intermediate transfer body 1 was prepared, the dispersion liquid A was added to a resin of polyimide varnish "UPIA-AT (U-Varnish-A)" (manufactured by Ube Industries, Ltd.) so that barium titanate was 10% by volume as indicated in Table I, and a coating liquid A for forming a substrate layer was prepared by using a mixer. In the same manner, the dispersion liquid B was added to a resin of polyimide varnish "UPIA-AT (U-Varnish-A)" (manufactured by Ube Industries, Ltd.) so that carbon black was 15% by volume as indicated in Table I, and a coating liquid B for forming a substrate layer was prepared by using a mixer. Next, as in the case of the intermediate transfer body 1, a stainless steel cylindrical mold was used to discharge the coating liquid A for forming a substrate layer to form a coating film. Then, by heating the coating film, an endless belt-shaped substrate layer composed of barium titanate and a resin was formed. Further, the coating liquid B for forming a substrate layer was applied by a dip coating method to form a double-layered endless belt-shaped substrate layer including a layer in which barium titanate was dispersed and a layer in which carbon black was dispersed. Further, SSG HB21B (manufactured by Nittobo Medical Co., Ltd.) was applied onto the intermediate transfer body 11 by a dip coating method to form a surface layer.

<Relative Permittivity>

As illustrated in FIG. 5, a thin film electrode 201 having a resistance of one digit Ω was formed on both surfaces of the intermediate transfer body 87*a* by sputtering and cut out with a 10 mmφ mold to prepare a measurement sample. Using an impedance analyzer "1260/1296" (made of Solartron Analytical Co., Ltd.), the dielectric constant (F/m) was measured by the electrode contact method under the conditions of a frequency of 1 MHz and a temperature of 23° C. and a humidity of 50% RH. The relative permittivity was obtained by conversion.

<Layer Structure>

Each of the intermediate transfer bodies prepared above was observed and photographed at a magnification of 3000 using a scanning electron microscope. Based on judgment that whether an interface in the layer was visible or not, it was confirmed that the intermediate transfer body was a single layer or not. The term "interface" as used herein refers to a boundary between the regions in which dielectric particles are dispersed and the regions in which conductors are dispersed are separated. However, unlike the region in which the above-mentioned dielectric or conductor is dispersed, the agglomerate in which several particles are collected was regarded as forming a single layer. As a result, in the intermediate transfer bodies 1 to 10, the components constituting the substrate layer were uniformly dispersed to form a single layer, but in the intermediate transfer body 11, the components constituting the substrate layer were unevenly distributed. The interface was formed in the layer, and it was not a single layer structure.

[Evaluation]

The transferability and mechanical strength of each of the intermediate transfer bodies produced above were evaluated. The above-mentioned intermediate transfer body was mounted on an image forming apparatus "KONICA MINOLTA Bizhub™ PRESS C11000" (manufactured by Konica Minolta Inc.), and the following evaluation test was performed using embossed paper (Leathac paper 302 g) as an image support.

After printing 1 million sheets of images with a printing rate of 20%, the operation of outputting 1000 sheets of black halftone images on one side of the embossed paper was performed. The obtained visible image was visually confirmed and the image quality of the black halftone image was evaluated (transferability evaluation) according to the following evaluation criteria. Further, a bending test (mechanical strength evaluation) of the intermediate transfer body after printing 1 million sheets was carried out.

<Transferability>

The evaluation criteria for transferability are as follows.

AA: No uneven transfer is observed.

BB: There is slight transfer unevenness in the concave portion of the embossed paper, but it is recognized that there is no problem in practical use.

CC: There is slight transfer unevenness on the convex part of the embossed paper, but it is recognized that there is no problem in practical use.

DD: It is recognized that there is a problem in practical use due to uneven transfer on the entire paper.

<Mechanical Strength>

After outputting the black halftone image, a bending test (MIT test) was performed in accordance with JIS P8115. The number of reciprocations until breakage was measured and evaluated according to the following evaluation criteria. When the number of reciprocations until breakage is 6000 or more, it is estimated that there is almost no possibility of breaking during use, and when it is less than 1000, there is a high risk of the belt breaking during printing, and it was rejected.

TABLE 1

| | Ferroelectric particles | | | | | | Conductor | |
|---|---|---|---|---|---|---|---|---|
| Intermediate transfer body. | Ferroelectric particles present (○) or absent (X) | Kind of titanic salt | Average primary particle diameter (nm) | Value of ratio (c/a) | Added Amount (% by volume) | Relative permittivity | Conductor, present (○) or absent (x) | Kind of conductor |
| 1 | ○ | Barium titanate | 100 | 1.009 | 15 | 50 | ○ | Carbon black |
| 2 | ○ | Barium titanate | 100 | 1.006 | 20 | 15 | ○ | Carbon nanotube |
| 3 | ○ | Barium titanate | 100 | 1.010 | 3 | 10 | ○ | Carbon black |
| 4 | ○ | Barium titanate | 90 | 1.008 | 30 | 30 | ○ | Carbon black |
| 5 | ○ | Barium titanate | 50 | 1.009 | 20 | 40 | x | — |
| 6 | ○ | Barium titanate | 30 | 1.007 | 25 | 35 | ○ | Carbon black |
| 7 | ○ | Strontium titanate | 200 | 1.009 | 25 | 9 | ○ | Carbon black |
| 8 | ○ | Barium titanate | 110 | 1.009 | 15 | 50 | ○ | Carbon black |
| 9 | ○ | Barium titanate | 100 | 1.009 | 5 | 30 | ○ | Carbon black |
| 10 | ○ | Barium titanate | 100 | 1.003 | 20 | 5 | ○ | Carbon black |
| 11 | ○ | Barium titanate | 500 | 1.010 | 10 | 7 | ○ | Carbon black |

| Intermediate transfer body. | Conductor Added amount (% by volume) | Layer composition | Surface layer, present (○) or absent (X) | Evaluation: Transferability | Evaluation: Mechanical strength | Remarks |
|---|---|---|---|---|---|---|
| 1 | 7 | Single layer | ○ | AA | AA | Present Invention |
| 2 | 0.5 | Single layer | ○ | BB | AA | Present Invention |
| 3 | 10 | Single layer | ○ | BB | AA | Present Invention |
| 4 | 25 | Single layer | x | CC | CC | Present Invention |
| 5 | 0 | Single layer | ○ | CC | AA | Present Invention |
| 6 | 15 | Single layer | ○ | AA | CC | Present Invention |
| 7 | 9 | Single layer | ○ | BB | CC | Present Invention |
| 8 | 7 | Single layer | ○ | AA | AA | Present Invention |
| 9 | 7 | Single layer | ○ | BB | AA | Present Invention |
| 10 | 25 | Single layer | x | DD | BB | Comparative Example |
| 11 | 15 | Double layer | ○ | BB | DD | Comparative Example |

From the results shown above, it is recognized that the intermediate transfer body of the present invention is superior in transferability and mechanical strength to the intermediate transfer body of the comparative example.

Although embodiments of the present invention have been described and illustrated in detail, the disclosed embodiments are made for purposes of illustration and example only and not limitation. The scope of the present invention should be interpreted by terms of the appended claims

What is claimed is:

1. An intermediate transfer body comprising a layer containing ferroelectric particles, wherein the ferroelectric particles have an average primary particle diameter in the range of 200 nm or less; and when three-dimensional axes of crystal lattices of the ferroelectric particles are a-axis, b-axis, and c-axis, a ratio of lattice constants of the c-axis and the a-axis (c/a) is in the range of 1.006 or more.

2. The intermediate transfer body described in claim 1, wherein the layer containing the ferroelectric particles has a relative permittivity at a frequency of 1 MHz in the range of 10 to 60.

3. The intermediate transfer body described in claim 1, wherein the ferroelectric particles contain barium titanate or strontium titanate.

4. The intermediate transfer body described in claim 1, wherein the ratio (c/a) of the ferroelectric particles is in the range of 1.009 or more.

5. The intermediate transfer body described in claim 1, wherein a content of the ferroelectric particles is in the range of 5 to 30% by volume with respect to the entire layer containing the ferroelectric particles.

6. The intermediate transfer body described in claim 1, wherein the layer containing the ferroelectric particles contains a conductor.

7. The intermediate transfer body described in claim 6, wherein the conductor is carbon black.

8. The intermediate transfer body described in claim 6, wherein the conductor is a carbon nanotube.

9. The intermediate transfer body described in claim 6, wherein a content of the conductor is in the range of 0.1 to 20% by volume with respect to the entire layer containing the ferroelectric particles.

10. The intermediate transfer body described in claim 1, wherein the layer containing the ferroelectric particles is uniformly dispersed with components that form the layer containing the ferroelectric particles to form a single layer.

11. The intermediate transfer body described in claim 1, wherein a surface layer is provided on the layer containing the ferroelectric particles.

12. An electrophotographic image forming apparatus provided with the intermediate transfer body described in claim 1.

* * * * *